US009592551B2

(12) United States Patent
Larouche et al.

(10) Patent No.: US 9,592,551 B2
(45) Date of Patent: Mar. 14, 2017

(54) METAL TRANSFER TROUGH

(71) Applicant: RIO TINTO ALCAN INTERNATIONAL LIMITED, Montreal (CA)

(72) Inventors: André Larouche, Saguenay (CA); Éric Hébert, St-Honoré (CA); Danny Jean, La Baie (CA); Joseph Langlais, Jonquière (CA); Serge Lavoie, Jonquière (CA)

(73) Assignee: Rio Tinto Alcan International Limited, Montreal (CA)

( * ) Notice: Subject to any disclaimer, the term of this patent is extended or adjusted under 35 U.S.C. 154(b) by 234 days.

(21) Appl. No.: 14/377,640

(22) PCT Filed: Feb. 15, 2013

(86) PCT No.: PCT/CA2013/050120
§ 371 (c)(1),
(2) Date: Oct. 1, 2014

(87) PCT Pub. No.: WO2013/138922
PCT Pub. Date: Sep. 26, 2013

(65) Prior Publication Data

US 2015/0158084 A1 Jun. 11, 2015

(30) Foreign Application Priority Data

Mar. 22, 2012 (CA) ..... 2772550

(51) Int. Cl.
*B22D 35/06* (2006.01)

(52) U.S. Cl.
CPC ..... *B22D 35/06* (2013.01)

(58) Field of Classification Search
CPC ..... B22D 35/06
(Continued)

(56) References Cited

U.S. PATENT DOCUMENTS 3,738,777 A * 6/1973 von Starck ..... B22D 39/006 222/592
5,346,182 A 9/1994 Kurotobi et al.
2015/0158084 A1* 6/2015 Hebert ..... B22D 35/06 222/592

FOREIGN PATENT DOCUMENTS

CA 2083919 A1 5/1993
EP 0 161 051 A1 11/1985
(Continued)

OTHER PUBLICATIONS

Apr. 15, 2013—(WO) International Search Report and Written Opinion—PCT/CA2013/050120.
(Continued)

*Primary Examiner* — Scott Kastler
(74) *Attorney, Agent, or Firm* — Banner & Witcoff, Ltd.

(57) ABSTRACT

A trough for cooling and delivering molten metal to a casting station. The trough comprises a refractory portion for holding the molten metal and heat transfer means associated to external walls of the refractory portion for extracting heat from the molten metal. The heat transfer means may comprise a fluidized bed compartment for holding and fluidizing a fluidization material. Also, the heat transfer means may comprise a cooling jacket, an inner wall of the cooling jacket and the external walls of the refractory portion defining the fluidized bed compartment.

28 Claims, 7 Drawing Sheets

(58) Field of Classification Search
USPC ..... 266/196
See application file for complete search history.

(56) References Cited

FOREIGN PATENT DOCUMENTS

| | | | |
|---|---|---|---|
| GB | 2117687 | A | 10/1983 |
| WO | 87/04098 | A1 | 7/1987 |

OTHER PUBLICATIONS

Oct. 2, 2014—(WO) International Preliminary Report on Patentability—PCT/CA2013/050120.

* cited by examiner

METAL TRANSFER TROUGH

This application claims the benefit of Canadian Application No. 2,772,550, filed on Mar. 22, 2012, and PCT Application No. PCT/CA2013/050120, filed on Feb. 15, 2013, each of which are incorporated by reference in their respective entirety.

FIELD OF THE INVENTION

The present invention relates generally to a trough for cooling and delivering molten metal to a casting station. More specifically, the invention relates to a trough that allows for extraction of heat from the molten metal. The invention also relates to a method for controlling the temperature of the molten metal upon delivery to the casting station.

BACKGROUND OF THE INVENTION

A metal transfer trough is generally used to receive molten metal from a furnace and deliver it to a casting station, which for example carries moulds for casting metal pigs. The furnace may be used in a remelt shop or it may be fed from molten metal crucibles carrying hot metal which, in the aluminum industry, could have been siphoned directly from an aluminum electrolysis pot.

Generally, the transfer trough is insulated to ensure that the heat loss during transfer is minimized and energy is not wasted. However, in certain circumstances, the molten metal may be considered too hot for delivery to the casting station, and it is necessary to lower its temperature before delivery. Typically in such circumstances, the rate of casting is slowed down in order to allow enough time for the pigs to solidify before leaving the casting station. This brings about an undesirable reduction in the production rate of the plant. Alternatively, the holding time in the crucible is increased in order to allow the metal to cool down, which also results in production slowdowns.

Other systems for cooling molten metal during transfer are known in the art. For example, EP 0 161 051 describes a closed conduit which is immersed in a heat exchanger medium such as a fluidized bed of solid particles. Circulation of the molten metal into the conduit is effected using pressure without contact with the atmosphere. CA 2,083,919 discloses a partially inclined elongated conveying conduit for transporting molten metal within a diffusion furnace. The conduit comprises gas feed means for feeding an inert gas into the conduit, thereby forcing circulation of the molten metal.

There is a need for a system that allows for a more efficient cooling of the molten metal during transfer to the casting station and also that allows for control over the temperature of the molten metal upon delivery.

SUMMARY OF THE INVENTION

The invention relates to a cooling trough for delivering molten metal to a casting station. The trough allows for a more efficient cooling of the molten metal during transfer to the casting station and also allows for control over the temperature of the molten metal upon delivery. Moreover, the trough enables casting directly from the crucibles used in the aluminum industry as mentioned above. Therefore, cycle time, energy cost and number of furnaces are reduced. Advantageously, the refractory portion of the trough, which holds the molten metal, is made of a material that is more conductive than standard conductive refractory materials generally used in the art. The refractory portion can be shaped to further facilitate heat removal.

According to an aspect of the invention, the trough comprises a refractory portion for holding the molten metal and heat transfer means that is associated to external walls of the refractory portion for extracting heat from the molten metal. Advantageously, the heat transfer means comprises a fluidized bed. For this purpose, the trough is provided with a fluidized bed compartment for holding and fluidizing a fluidization material.

According to another aspect, the invention relates to a trough for cooling and delivering molten metal to a casting station, the trough being made of conductive ceramic material and having a first set of fins extending outwardly from external walls thereof, and a cooling jacket associated to the external walls so as to form a fluidized bed compartment between the trough and an inner wall of the cooling jacket, the first set of fins extending into the compartment. Advantageously, the heat transfer means comprises a fluidized bed. For this purpose, the trough is provided with a fluidized bed compartment for holding and fluidizing a fluidization material.

The invention further relates to a method for controlling the temperature of a molten metal being delivered to a casting station. The heat transfer means of the cooling trough extracts heat from the molten metal, thereby lowering its temperature. The heat transfer means can be operated such as to increase or decrease heat extraction at selected sections of thereof, thereby allowing for a control of the temperature of the molten metal upon delivery to the casting station.

According to an aspect, the method comprises the steps of: (a) providing a trough that comprises a refractory portion for holding molten metal and heat transfer means associated to lateral external walls of the refractory portion for extracting heat from the molten metal; (b) feeding the molten metal in the trough through an upper end portion thereof; (c) operating the heat transfer means such that the molten metal reaches a controlled casting temperature; and (d) delivering the molten metal which is at the controlled casting temperature to the casting station through a lower end portion of the trough.

BRIEF DESCRIPTION OF THE DRAWINGS

In order for the invention to be more clearly understood, an embodiment is described below with reference to the accompanying drawings, in which.

DESCRIPTION OF EMBODIMENTS OF THE INVENTION

Figure 1:
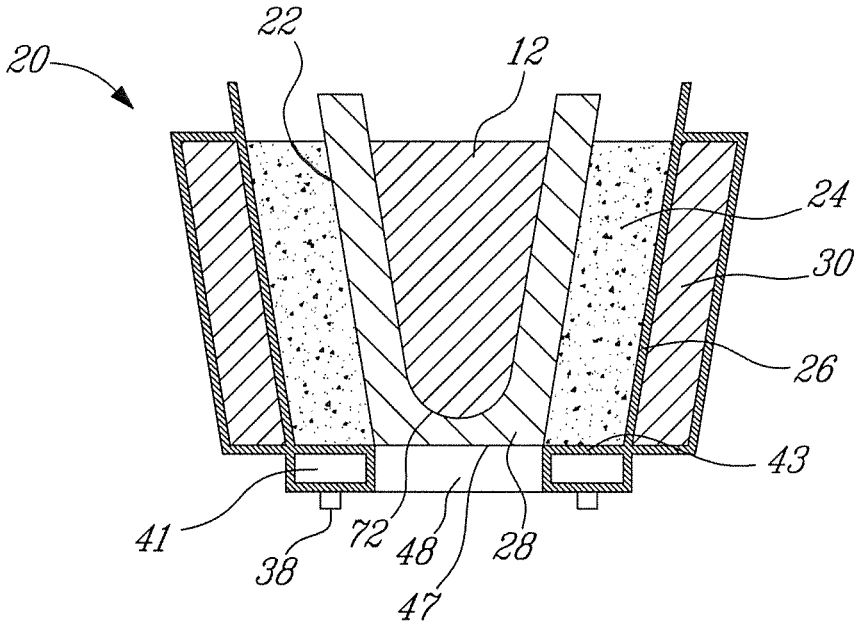
FIG. 1 is a longitudinal cross-sectional view of a metal transfer trough in accordance with an aspect of the invention.
Figure 2:
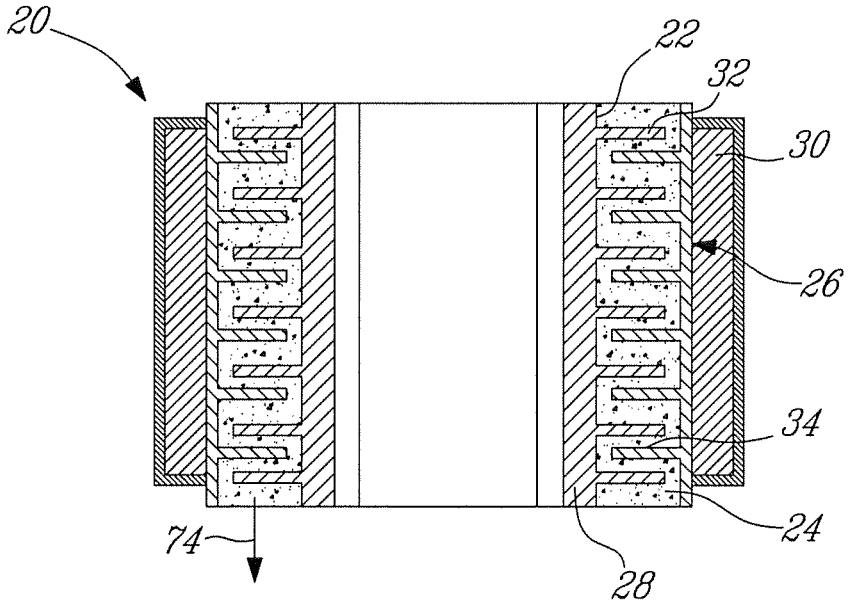
FIG. 2 is a top plan view of a metal transfer trough in accordance with an aspect of the invention.
Figure 8A:
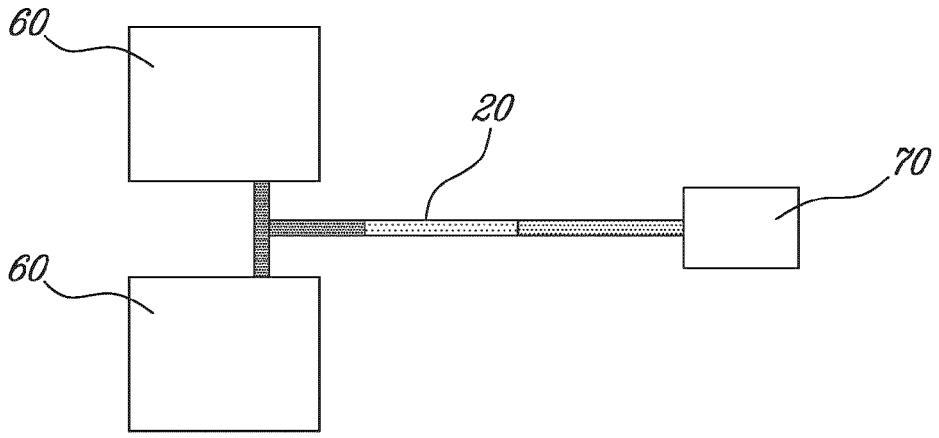
FIG. 8A illustrates use, in-line, of a metal transfer trough in accordance with an aspect of the invention.

Referring to FIGS. 1, 2 and 8A, a trough (20) for cooling and delivering molten metal (12) to a casting station (70) is shown. Trough (20) comprises a refractory portion (28) for holding the molten metal and heat transfer means associated to external walls (22) of the refractory portion. The heat transfer means allow for extraction of heat from the molten metal (12) in order to attain a targeted casting temperature. The heat transfer means comprises a fluidized bed compartment (24) defined by the external walls (22) of the refractory portion (28) and an inner wall (26) of a cooling jacket (30) that is associated to the external walls (22). The fluidized bed compartment (24) holds and fluidizes the fluidization material (74). In this specific embodiment, the cooling jacket is water-cooled. The casting station (70) may be for casting various types of products such as ingot chain casters and pure alloys.

As mentioned above, the heat transfer means extracts heat from the molten metal (12), thereby lowering its temperature upon entry to the casting station (70). More specifically and as will be described in greater detail below, heat on the refractory side is extracted and transported to the water cooled inner wall (26) by the fluidized material through mass transfer, conduction and radiation. The fluidized material ensures close contact between the refractory portion and the cooling jacket, thereby increasing the overall efficiency of heat extraction from the molten metal.

The refractory portion (28) of the trough (20) is made of conductive refractory or ceramic material. Conductive refractory materials include for example Ceramite™ CSA, aluminum nitride and silicon carbide. The cooling jacket (30) is made of heat conductive material such as aluminum, steel, copper or a combination thereof. The inner wall (26) of the cooling jacket may be made of the same material, or not, as the remainder of the cooling jacket. Preferably, the inner wall (26) of the cooling jacket is made of aluminum or copper.

A first set of fins (32) extends outwardly from the external walls (22) of the refractory portion (28) and into the fluidized bed compartment (24), as illustrated in FIG. 2. Fins (32) are oriented generally perpendicularly to a longitudinal axis of the trough; however, they may also be oriented at any other angle, as would be understood by those of ordinary skill in the art. Fins (32) are preferably made of the same conductive refractory material as the refractory portion (28) of the trough (20). They allow for a discharge of heat from the molten metal. Fins (32) are preferably unitary with the rest of the refractory portion (28).

Still referring to FIG. 2, a second set of fins (34) may extend inwardly from the inner wall (26) of the cooling jacket (30) and into the fluidized bed compartment (24). Fins (34) are oriented generally perpendicularly to a longitudinal axis of the trough; however, they may also be oriented at any other angle, as would be understood by those of ordinary skill in the art. Fins (34) are preferably made of the same heat conductive material as the inner wall (26) of the cooling jacket (30). Fins (34) are also preferably unitary with the inner wall of the cooling jacket.

The fluidized bed compartment (24) is formed by the external walls (22) of the refractory portion (28) and the inner wall (26) of the cooling jacket (30). In embodiments of the invention, fins (32) extending from external walls of the trough and/or fins (34) extending from an inner wall of the cooling jacket are present and located within the fluidized bed compartment (24). It should be noted that only one or both sets of fins (32, 34) may be present. In embodiments where both sets of fins (32, 34) are present, they are organized in a mating spaced-apart arrangement, as illustrated for example in FIG. 2. Fins (32, 34) may also be organized in a parallel arrangement, wherein respective ends of fins (32) and fins (34) are opposite to each other, as illustrated for example in FIG. 3. Moreover, fins (32, 34) may be organized in any other suitable configuration, as would be understood by those of skill in the art.

Fin density herein refers to the number of fins per length of the trough. Fin density may be adapted as desired depending on the amount of heat to be extracted from the molten metal. When fin density is increased, the amount of heat extracted from the molten metal is generally increased as would be understood by those of ordinary skill in the art. In embodiments of the invention, the distance between two consecutive fins, hereinafter fin spacing, is about 10 to about 300 mm; preferably, fin spacing is about 20 to about 50 mm; more preferably, fin spacing is about 20 to about 35 mm. Fin spacing for the first set of fins (32) and the second set of fins (34) may be the same or different. In embodiments of the invention, fin spacing for the first set of fins (32) is about 20 to about 30 mm and fin spacing for the second set of fins (34) is about 30 to about 40 mm. The length of fins (32, 34) may be about 50 to about 300 mm; preferably, about 80 to about 120 mm.

Figure 3:
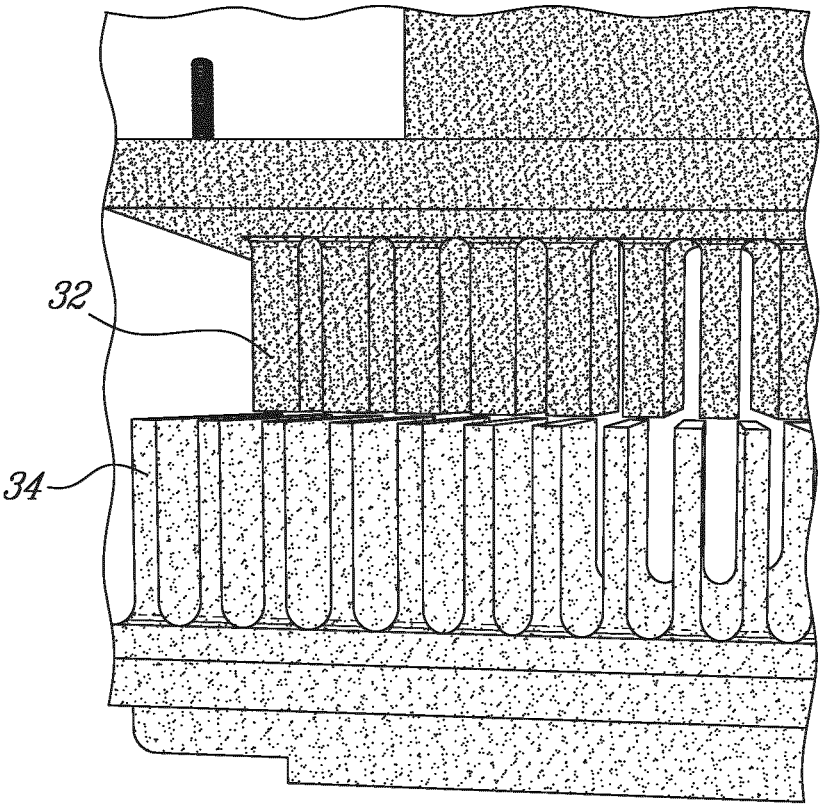
FIG. 3 illustrates a parallel configuration of the fins in a metal transfer trough in accordance with an aspect of the invention.

In embodiments of the invention wherein fins (32, 34) are organized in a parallel configuration as illustrated for example in FIG. 3, fin spacing may be about 100 to about 300 mm and the thickness of the fins may be increased.

In embodiments of the invention, a thickness of the base (72) of the refractory portion (28) is about 10 to about 80 mm; preferably about 40 mm. In other embodiments, a thickness of the base of the cooling jacket (30) (part of the jacket which does not have any fins extending therefrom) is about 5 to about 20 mm; preferably, a cooling jacket thickness is about 8 to about 15 mm.

A particulate fluidization material (74) is provided in the fluidized bed compartment (24). Examples of such material include: alumina, alumina mixed with a mineral oxide, silica oxide, or a combination thereof. The fluidization material can be from various sources and can be of various grain size and porosity. The nature and size of the fluidization material may be optimized to obtain better heat extraction efficiency. In embodiments of the invention, the grain size of the fluidization material is about 50 to about 600 μm; preferably, the grain size is about 150 to about 400 μm; more preferably, the grain size is about 250 μm.

Fluidization is activated to effect heat transfer thereby cooling the molten metal. The fluidized particles extract heat at the external walls (22) of the refractory portion (28) of the trough (20) and at the fins (32), and by mass transfer (collision, friction), the heat is conveyed by the fluidized particles to fins (34) and inner wall (26) of the cooling jacket (30).

Figure 5:
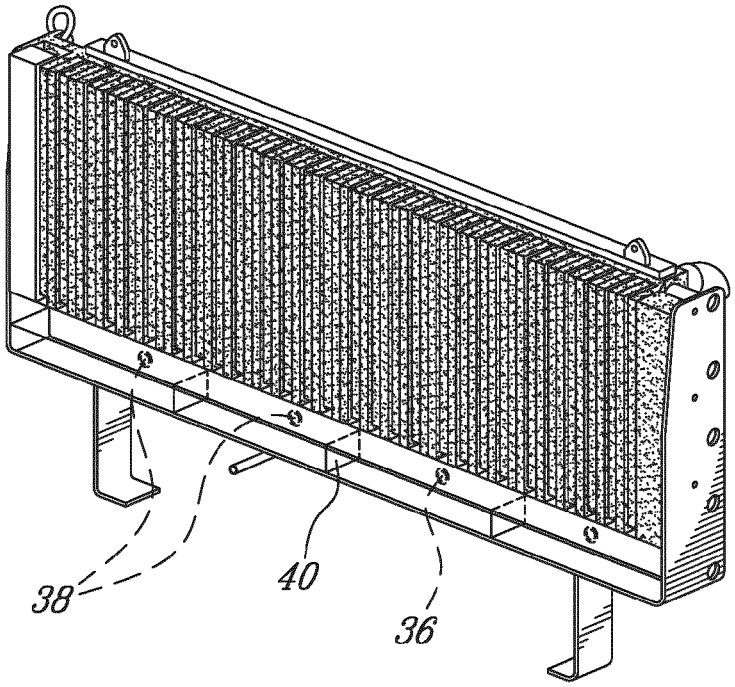
FIG. 5 is a longitudinal cross-sectional view of a metal transfer trough in accordance with an aspect of the invention.

Referring to FIGS. 1 and 5, fluidization is activated by allowing gas to enter the fluidized bed compartment (24) through gas inlet (38). The fluidized bed compartment (24) comprises a gas chamber (41), a main gas valve (42) (FIG. 7B) and a gas diffuser or pressure plate (43) provided at a bottom section of the fluidized bed compartment (24). Once fluidization is stopped, particles of the fluidization material (74) rest on the gas diffuser or pressure plate. The non-fluidized particles in the compartment act as an insulator due to high air void fraction therein. The on/off utilization of the fluidization results in more or less heat being extracted from the molten metal (12).

Figure 4:
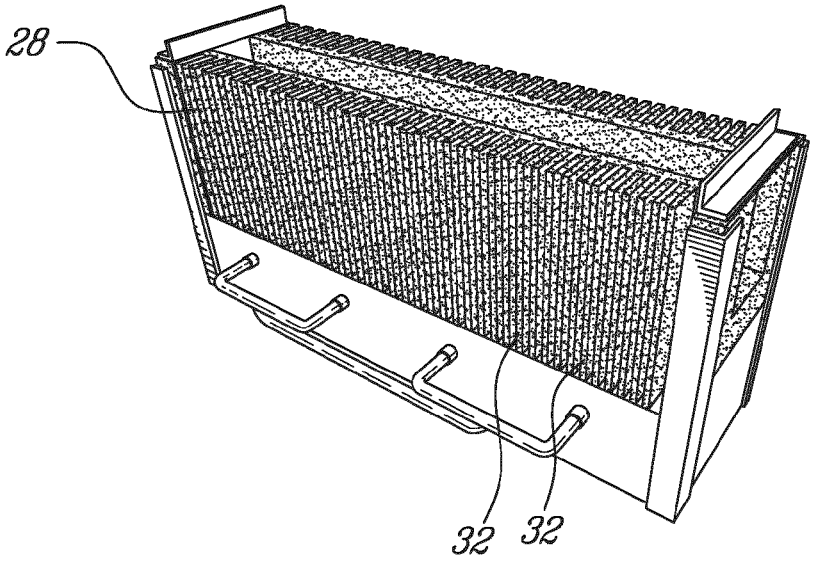
FIG. 4 is a perspective view of a refractory portion of a metal transfer trough in accordance with an aspect of the invention.

In an embodiment of the invention, the fluidized bed compartment (24) is divided into a plurality of sections, for example A, B, C . . . , by for example division plates (40) in gas chamber (41). Each section is provided with a separate air inlet (38A, 38B, 38C . . . ) and air valve (39A, 39B, 39C . . . ) and can be operated separately and independently from the other sections. Fluidization may thus be effected at selected sections thereby fluidizing only selected sections of the fluidized bed compartment (24). The effective length of the cooling trough can thus be varied as desired, allowing for control over the temperature of the molten metal. The effective trough length refers to the percentage of the trough in which fluidization is carried out. This embodiment is illustrated in FIGS. 4 5 and 7B.

The cooling jacket is operated by circulating water therein, at a suitable flow rate. Any suitable coolant, other than water, may be used, as would be understood by those of skill in the art. The trough is provided with a water flow meter (46) and a main water valve (49).

Figure 7A:
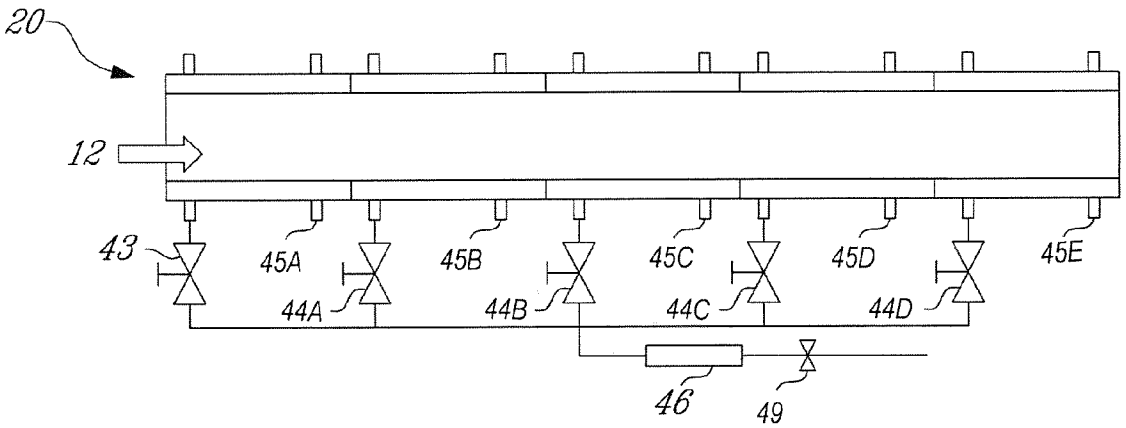
FIG. 7A is a top plan view of a metal transfer trough in accordance with an aspect of the invention.
Figure 7B:
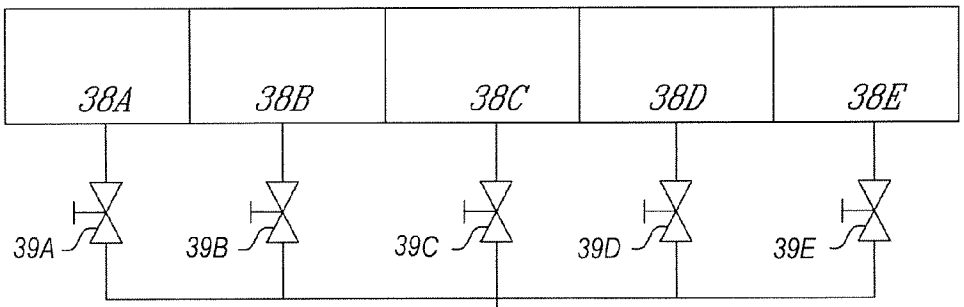
FIG. 7B is a side view of the metal transfer trough of FIG. 6A.

Referring to FIG. 7A, water jacket (30) may also be divided into sections, for example A, B, C . . . Each section may have a separate water valve (44A, 44B, 44C . . . ) and a separate water drain (45A, 45B, 45C . . . ) and can be operated separately and independently. In embodiments of the invention, in operation, water flow is always maintained at a certain level even when fluidization is stopped.

Referring to FIG. 1, a heat insulator (48) may be provided at a bottom section (47) of the refractory portion (28) of the trough (20). A suitable insulator is used, for example insulants from Pyrotek (M-series Compressible Insulating board, Isomag™), or Unifrax (Isofrax™, Insulfrax™, Fiberfrax™).

FIG. 3 shows a refractory portion (28) of the trough according to an embodiment of the invention. In specific embodiments of the invention, the refractory portion (28) is for example made of Ceramite™ CSA material, and fins (32) extend from external lateral walls of the refractory portion.

Figure 6:
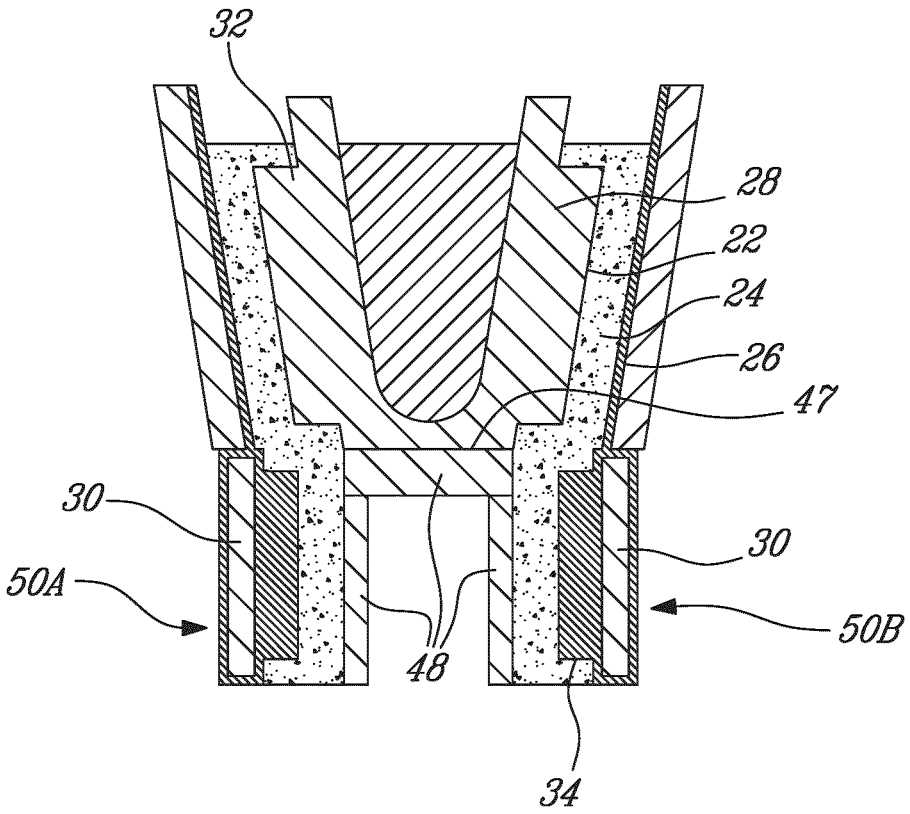
FIG. 6 is a longitudinal cross-sectional view of a metal transfer trough in accordance with another aspect of the invention.

In another embodiment and referring to FIG. 6, the heat transfer means may extend at a lower section below a lower edge of the refractory portion (28) of the trough (20). In this embodiment of the invention, the heat transfer means at the lower section comprises first and second spaced-apart, substantially parallel portions (50A, 50B), and each portion is provided with a cooling jacket (30), which is for example water-cooled. Also in this embodiment, the insulator (48) is associated to an external surface of a bottom section (47) of the refractory portion (28) of the trough (20) and also to an inner wall of the first and second portions of the heat transfer means (50A , 50B). This embodiment provides the advantage of higher fin density for both the first and second sets of fins (32, 34), thereby allowing for higher heat extraction from the molten metal. Further, this embodiment prevents contact between molten metal which may have leaked from the refractory portion (28) and the water of the cooling jacket (30), thereby ensuring safe use of the trough.

Figure 8B:
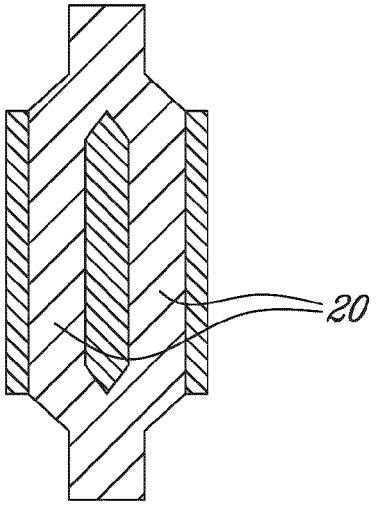
FIG. 8B illustrates use, in parallel configuration, of a metal transfer trough in accordance with an aspect of the invention.

Dimensions (length, height and width) of the trough are adjusted as necessary, depending on the desired controlled casting temperature for the molten metal as well as the amount of metal and the molten metal flow rate. The trough is provided between furnace(s) (60) and the casting station (70). The trough (20) can be used in-line as illustrated for example in FIG. 8A, or in parallel configuration as illustrated for example in FIG. 8B. The parallel configuration is especially useful for Brownfield applications in which space is limited. As is known by those of skill in the art, Brownfield refers to installations (furnace, crucible, casting stations, etc . . . ) that are already in place and have therefore limited space. Parallel configurations of the trough allow for enhanced heat extraction from the molten metal while adapting to the space available.

The trough according to the invention has been illustrated for the delivery and cooling of molten aluminum and aluminum alloys. However, the trough may also be used to deliver and cool any other metal or alloy, as would be appreciated by those of skill in the art.

Operation of the trough may advantageously be controlled with temperature sensor array connected to computer means with feedback loop to various values or activators so as to provide in-process controls.

Examples of Situations and Control

In the embodiments of FIGS. 7A and 7B, the trough is divided into five sections, each section having the capacity of decreasing the temperature of molten aluminum by 6° C. It should be noted that the cooling trough has a lower range of operation when fluidization is off. Indeed, it has been determined that when fluidization is off, the temperature drop is approximately three-time lower than the maximum capacity when fluidization is on. Accordingly, in the example outlined above in relation to FIGS. 7A and 7B, the cooling through extracts approximately 2° C. in the sections where fluidization is off.

a) Where a maximum temperature drop of 30° C. is targeted: all sections of the fluidized bed compartment are fluidized and water flow rate is set at the same value, such as to allow for a 6° C. decrease in temperature in each section.

b) Where a temperature drop of 18° C. is targeted: two sections of the fluidized bed compartment are fluidized and water flow rate in each section of the water jacket is set at the same value. Fluidization is off for three sections of the fluidized bed compartment and water flow rate is reduced in order not to overcool.

c) Where a temperature drop of 28° C. is targeted: all sections of the fluidized bed compartment are fluidized; one section with a lower air flow and the water jacket is operated with reduced water flow.

Examples of Temperature Control-1

Figure 9A:
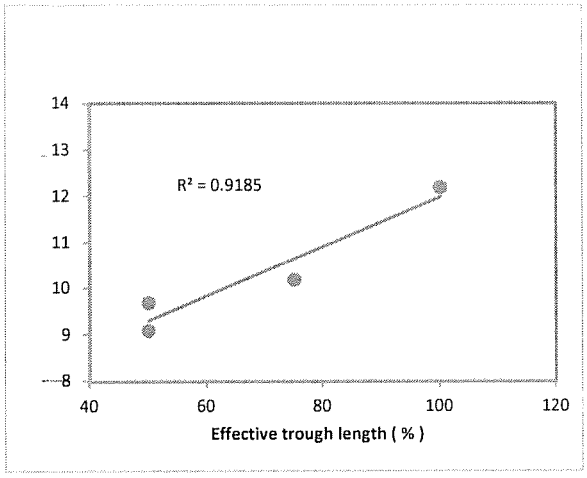
FIG. 9A illustrates the effect of effective trough length on specific temperature loss.
Figure 9B:
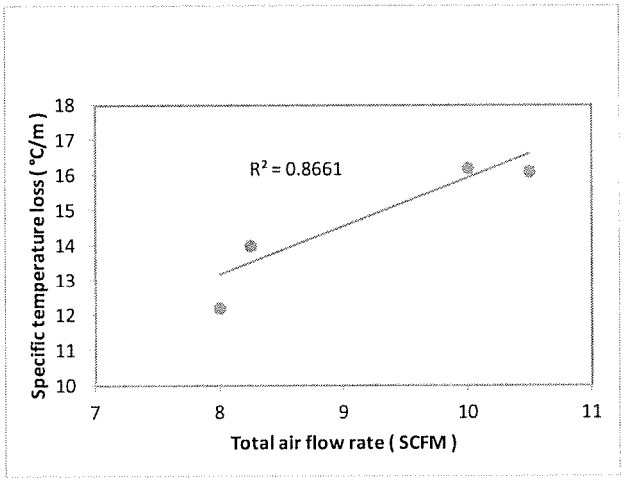
FIG. 9B illustrates the effect of fluidized air flow rate on specific temperature loss.

The graph on FIG. 9A shows the effect, on specific temperature loss, of the effective trough length. As mentioned above, the effective trough length refers to the percentage of the trough length that was fluidized. In this example, the air flow rate was adjusted in order to have the same fluidization in all sections of the trough that were fluidized. The graph on FIG. 9B shows the effect of the air flow rate when a 100% effective trough length was used.

Examples of Temperature Control-2

At a molten metal flow rate of 13 t/hr and for a molten metal level of 277 mm, the molten metal temperature drop ranges between 5.5° C./m to 16.2° C./m depending on operating conditions. Typical temperature drop at higher flow rate in a typical aluminum casting plant ranges between 2 to 4° C./m. Heat extraction rate is modulated between the range indicated above by varying fluidization air flow rate and by performing fluidization at selected sections of the fluidized bed compartment (use of effective trough length). The following table summarizes the cooling trough length in meters in order to meet desired molten metal temperature drop at specific flow rate with actual performances.

| Temperature | Molten metal flow rate ( t/hr ) | | | | |
|---|---|---|---|---|---|
| drop ( ° C.) | 5 | 15 | 30 | 40 | 50 |
| 5 | 0.1 | 0.3 | 0.7 | 0.9 | 1.1 |
| 10 | 0.2 | 0.7 | 1.4 | 1.8 | 2.3 |
| 20 | 0.5 | 1.4 | 2.8 | 3.7 | 4.6 |
| 30 | 0.7 | 2.1 | 4.1 | 5.5 | 6.9 |
| 50 | 1.1 | 3.4 | 6.9 | 9.2 | 11.5 |

Although the present invention has been described hereinabove by way of embodiments thereof, it may be modified, without departing from the nature and teachings of the subject invention as defined in the appended claims.

What is claimed is:

1. A trough for cooling and delivering molten metal to a casting station, the trough being made of thermally conductive material and having a first set of fins extending outwardly from external walls thereof, and a cooling jacket associated to the external walls so as to form a fluidized bed compartment between the trough and an inner wall of the cooling jacket, wherein the compartment comprises a fluidization material, and is adapted to fluidize the fluidization material into the compartment.

2. The trough according to claim 1, wherein a second set of fins extends inwardly from the inner wall of the cooling jacket and into the fluidized bed compartment.

3. A trough for cooling and delivering molten metal to a casting station, the trough being made of thermally conductive material, and a cooling jacket having fins extending inwardly from an inner wall thereof is associated to external walls of the trough so as to form a fluidized bed compartment between the trough and the cooling jacket, wherein the compartment comprises a fluidization material, and is adapted to fluidize the fluidization material into the compartment.

4. The trough according to claim 1, wherein the fluidized bed compartment is divided into a plurality of sections for selectively fluidizing the fluidization material into sections of the compartment.

5. The trough according to claim 1, which is made of ceramic material, aluminum nitride, or silicon carbide.

6. The trough according to claim 1, wherein the cooling jacket is water-cooled; and/or the cooling jacket is made of aluminum, steel, copper or a combination thereof.

7. The trough according to claim 1, wherein the fluidization material is alumina, alumina mixed with a mineral oxide, silica oxide or a combination thereof; and/or a grain size of the fluidization material is about 50 to about 600 μm.

8. The trough according to claim 1, further comprising an insulator associated to an external surface of a bottom section of the trough.

9. The trough according to claim 1, wherein a distance between two consecutive fins is about 10 to about 300 mm; and/or a length of each fin is about 50 to about 300 mm.

10. A method for controlling the temperature of a molten metal being delivered to one or more casting stations, comprising:

(a) providing two or more troughs, each trough being as defined in claim 1;

(b) feeding the molten metal in each trough through an upper end portion thereof; and (c) delivering the molten metal to the one or more casting stations through a lower end portion of the trough.

11. The method according to claim 10, wherein the two or more troughs are used in in-line or in parallel configuration.

12. The method according to claim 10, wherein in the molten metal in step (c) is at a temperature which is lower than a temperature of the molten metal in step (b).

13. The trough according to claim 3, wherein the fluidized bed compartment is divided into a plurality of sections for selectively fluidizing the fluidization material into sections of the compartment.

14. The trough according to claim 3, which is made of ceramic material, aluminum nitride, or silicon carbide.

15. The trough according to claim 3, wherein the cooling jacket is water-cooled; and/or the cooling jacket is made of aluminum, steel, copper or a combination thereof.

16. The trough according to claim 3, wherein the fluidization material is alumina, alumina mixed with a mineral oxide, silica oxide or a combination thereof; and/or a grain size of the fluidization material is about 50 to about 600 μm.

17. The trough according to claim 3, further comprising an insulator associated to an external surface of a bottom section of the trough.

18. The trough according to claims 3, wherein a distance between two consecutive fins is about 10 to about 300 mm; and/or a length of each find is about 50 to about 300 mm.

19. A method for controlling the temperature of a molten metal being delivered to one or more casting stations, comprising:

(a) providing two or more troughs, each trough being as defined in claim 3;

(b) feeding the molten metal in each trough through an upper end portion thereof; and (c) delivering the molten metal to the one or more casting stations through a lower end portion of the trough.

20. The method according to claim 19, wherein in the molten metal in step (c) is at a temperature which is lower than a temperature of the molten metal in step (b).

21. The trough according to claim 1, further comprising means for fluidizing the fluidization material within the compartment.

22. The trough according to claim 1, further comprising a gas inlet configured for allowing gas to enter the fluidized bed compartment to fluidize the fluidization material.

23. The trough according to claim 22, further comprising a gas chamber, a main gas valve, and a gas diffuser or pressure plate in communication with the gas inlet, wherein the trough is configured such that the gas passes through the gas chamber, the main gas valve, and the gas diffusers or pressure plates while entering the fluidized bed compartment.

24. The trough according to claim 23, further comprising a plurality of gas inlets configured for allowing gas to enter the fluidized bed compartment to fluidize the fluidization material, a plurality of gas chambers, a plurality of main gas valves, and a plurality of gas diffusers or pressure plates, wherein each gas inlet has one of the gas chambers, one of the main gas valves, and one of the gas diffusers or pressure plates in communication therewith, wherein the trough is configured such that the gas passes through the gas inlets, the gas chambers, the main gas valves, and the gas diffusers or pressure plates while entering the fluidized bed compartment.

25. The trough according to claim 3, further comprising means for fluidizing the fluidization material within the compartment.

26. The trough according to claim 3, further comprising a gas inlet configured for allowing gas to enter the fluidized bed compartment to fluidize the fluidization material.

27. The trough according to claim 26, further comprising a gas chamber, a main gas valve, and a gas diffuser or pressure plate in communication with the gas inlet, wherein the trough is configured such that the gas passes through the gas chamber, the main gas valve, and the gas diffusers or pressure plates while entering the fluidized bed compartment.

28. The trough according to claim 27, further comprising a plurality of gas inlets configured for allowing gas to enter the fluidized bed compartment to fluidize the fluidization material, a plurality of gas chambers, a plurality of main gas valves, and a plurality of gas diffusers or pressure plates, wherein each gas inlet has one of the gas chambers, one of the main gas valves, and one of the gas diffusers or pressure plates in communication therewith, wherein the trough is configured such that the gas passes through the gas inlets, the gas chambers, the main gas valves, and the gas diffusers or pressure plates while entering the fluidized bed compartment.

* * * * *